US010101040B2

(12) United States Patent
Phillips et al.

(10) Patent No.: US 10,101,040 B2
(45) Date of Patent: Oct. 16, 2018

(54) PACKAGED TERMINAL AIR CONDITIONER UNIT

(71) Applicant: General Electric Company, Schenectady, NY (US)

(72) Inventors: Richard Michael Phillips, Louisville, KY (US); Wilbur Carl Bewley, Jr., Nicholasville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 431 days.

(21) Appl. No.: 14/859,430

(22) Filed: Sep. 21, 2015

(65) Prior Publication Data

US 2017/0082303 A1 Mar. 23, 2017

(51) Int. Cl.
*F24F 1/02* (2011.01)
*F24F 13/06* (2006.01)
*F24F 13/20* (2006.01)

(52) U.S. Cl.
CPC ..... *F24F 1/027* (2013.01); *F24F 13/06* (2013.01); *F24F 13/20* (2013.01)

(58) Field of Classification Search
CPC ..... F24F 1/027; F24F 13/06; F24F 13/20
USPC ..... 454/202
See application file for complete search history.

(56) References Cited

U.S. PATENT DOCUMENTS 5,295,531 A * 3/1994 Tsunekawa ..... F24F 1/027 165/48.1
5,327,956 A * 7/1994 Bolton ..... F24F 1/025 165/121
5,467,610 A * 11/1995 Bolton ..... F24F 1/027 312/236
5,467,615 A * 11/1995 Bolton ..... F16L 5/00 165/135
5,622,058 A * 4/1997 Ramakrishnan ..... F24F 13/20 62/295
6,318,105 B1 * 11/2001 Bushnell ..... F24F 1/027 62/262
6,497,740 B1 * 12/2002 Moretti ..... B01D 46/001 55/418
9,702,570 B2 * 7/2017 Phillips ..... F24F 1/022
2002/0171338 A1 * 11/2002 Wetterberg ..... F24F 13/20 312/236
2014/0167405 A1 * 6/2014 Lahey ..... F24F 13/32 285/64

* cited by examiner

*Primary Examiner* — Kenneth Rinehart
*Assistant Examiner* — Phillip E Decker
(74) *Attorney, Agent, or Firm* — Dority & Manning, P.A.

(57) ABSTRACT

A packaged terminal air conditioner unit includes a bulkhead positioned between an interior coil and an exterior coil within a casing. A vent assembly of the packaged terminal air conditioner unit includes a base received within an opening of the bulkhead. The bulkhead is positioned between a plurality of projections and a frame of the vent assembly. A door of the vent assembly is pivotally mounted to the base.

18 Claims, 12 Drawing Sheets

PACKAGED TERMINAL AIR CONDITIONER UNIT

FIELD OF THE INVENTION

The present subject matter relates generally to packaged terminal air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. Generally, one-unit type air conditioner units include an indoor portion and an outdoor portion. The indoor portion is generally located indoors, and the outdoor portion is generally located outdoors. Accordingly, the air conditioner unit generally extends through a wall, window, etc. of the structure.

It may be desirable to allow outdoor air through from an exterior atmosphere through the air conditioner into a room into which the air conditioner unit extends. Accordingly, certain air conditioners include vent apertures for allowing such airflow. To allow a user to choose whether to allow such outdoor air through the air conditioner, a cap may be provided which can be connected to an inner wall by a number of screws or removed from the inner wall via unscrewing of the screws, depending on the preference of the user. Such caps and the use of screws to connect such caps to inner walls, however, have a number of disadvantages. For example, connecting and disconnecting of a cap is labor intensive and requires disassembly of many component of the air conditioner unit in order to access the screw locations. Further, such caps are separate components which are prone to being lost when disconnected from associated inner walls.

Accordingly, venting apparatus for air conditioner units which reduce associated labor requirements and loss risks would be advantageous.

BRIEF DESCRIPTION OF THE INVENTION

The present subject matter provides a packaged terminal air conditioner unit having a bulkhead positioned between an interior coil and an exterior coil within a casing. A vent assembly includes a base received within an opening of the bulkhead. The bulkhead is positioned between a plurality of projections and a frame of the vent assembly. A door of the vent assembly is pivotally mounted to the base. Additional aspects and advantages of the invention will be set forth in part in the following description, or may be apparent from the description, or may be learned through practice of the invention.

In a first exemplary embodiment, a packaged terminal air conditioner unit defines a vertical direction, a lateral direction and a transverse direction that are mutually perpendicular. The packaged terminal air conditioner includes a casing. A compressor is positioned within the casing and is operable to increase a pressure of a refrigerant. An interior coil is positioned within the casing, and an exterior coil is also positioned within the casing. A bulkhead is positioned between the interior coil and the exterior coil along the transverse direction within the casing. The bulkhead defines an opening that extends through the bulkhead along the transverse direction. The bulkhead also defines a plurality of slots at the opening of the bulkhead. A vent assembly includes a base received within the opening of the bulkhead. A frame is mounted to the base and is positioned on the bulkhead at the opening of the bulkhead. A plurality of projections is mounted to the base and is positioned on the bulkhead at the opening of the bulkhead. The bulkhead is positioned between the plurality of projections and the frame along the transverse direction. The slots of the plurality of slots are sized for receiving the projections of the plurality of projections. Each slot of the plurality of slots is offset from a respective projection of the plurality of projections when the vent assembly is mounted to the bulkhead. A door is pivotally mounted to the base.

In a second exemplary embodiment, a packaged terminal air conditioner unit defines a vertical direction, a lateral direction and a transverse direction that are mutually perpendicular. The packaged terminal air conditioner includes a casing that extends between an exterior side portion and an interior side portion along the transverse direction. A compressor is positioned within the casing. The compressor is operable to compress a refrigerant. An interior coil is positioned within the casing at the interior side portion of the casing, and an exterior coil is positioned within the casing at the exterior side portion of the casing. A bulkhead is positioned between the interior coil and the exterior coil along the transverse direction within the casing. The bulkhead defines an opening that extends through the bulkhead along the transverse direction. The bulkhead also defines a plurality of slots at the opening of the bulkhead. A vent assembly includes a base received within the opening of the bulkhead. A frame is mounted to the base and positioned on the bulkhead at the opening of the bulkhead and at the exterior side portion of the casing. A plurality of projections is mounted to the base and is positioned opposite the frame about the bulkhead such that the bulkhead is positioned between the plurality of projections and the frame along the transverse direction. The slots of the plurality of slots are sized for receiving the projections of the plurality of projections. Each slot of the plurality of slots is offset from a respective projection of the plurality of projections along the lateral direction when the vent assembly is mounted to the bulkhead. A door is pivotally mounted to the base.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
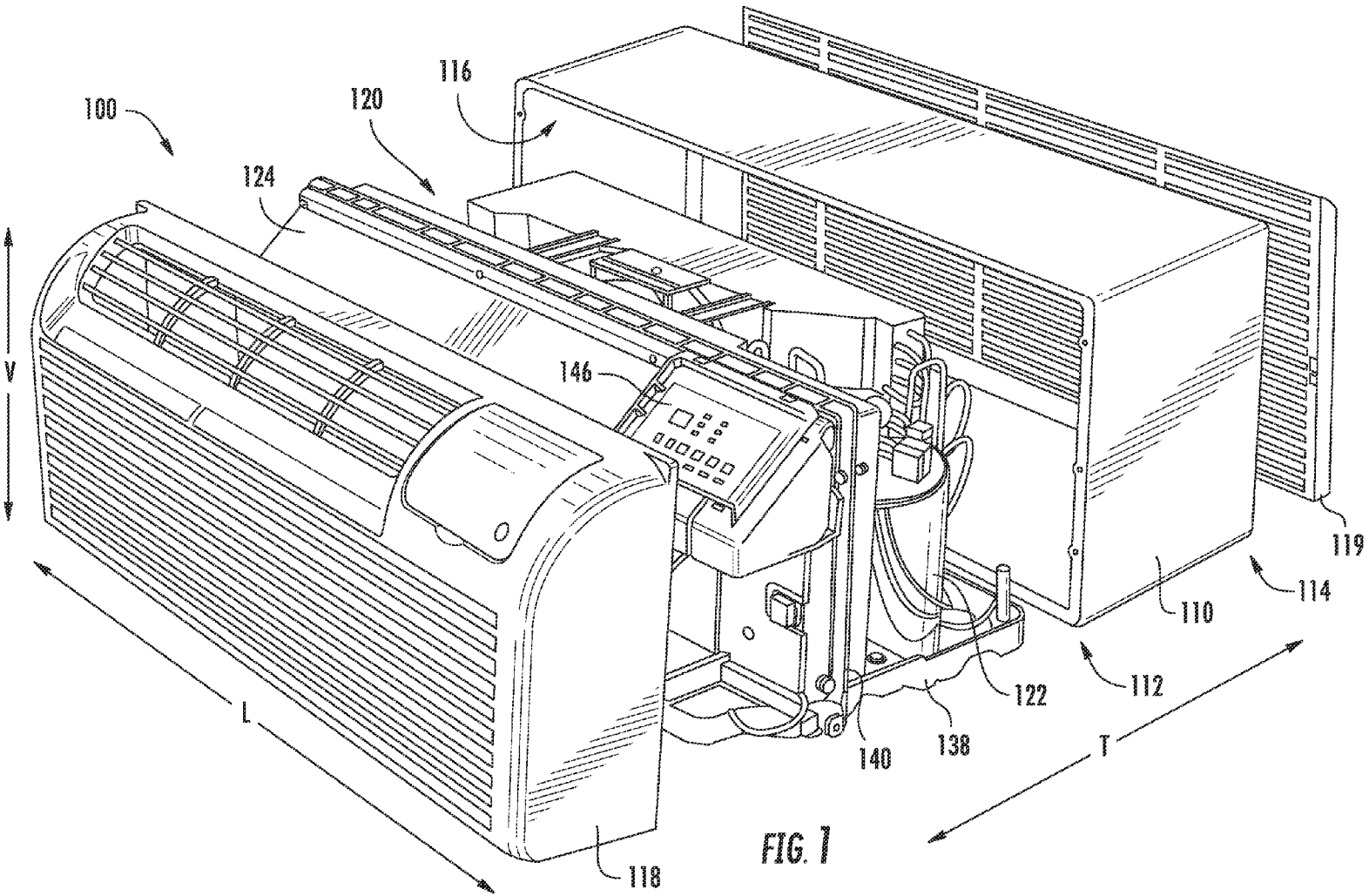
FIG. 1 provides an exploded perspective view of a packaged terminal air conditioner unit according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an exemplary embodiment of the present subject matter. Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air. Packaged terminal air conditioner unit 100 defines a vertical direction V, a lateral direction L and a transverse direction T that are mutually perpendicular and form an orthogonal direction system.

As used herein, the term "packaged terminal air conditioner unit" is used broadly. For example, packaged terminal air conditioner unit 100 may include a supplementary electric heater (not shown) for assisting with heating air within the associated room or building without operating the sealed system 120. However, as discussed in greater detail below, packaged terminal air conditioner unit 100 may also include a heat pump heating mode that utilizes sealed system 120, e.g., in combination with an electric resistance heater, to heat air within the associated room or building. Thus, it should be understood that "packaged terminal air conditioner unit" as used herein is intended to cover both units with and without heat pump heating modes.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere, as discussed in greater detail below.

Casing 110 defines a mechanical compartment 116. Sealed system 120 is disposed or positioned within mechanical compartment 116 of casing 110. A front panel 118 and a rear grill or screen 119 hinder or limit access to mechanical compartment 116 of casing 110. Front panel 118 is positioned at or adjacent interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall or bulkhead 140 positioned within mechanical compartment 116 of casing 110. Sealed system 120 is positioned on bottom tray 138. Thus, liquid runoff from sealed system 120 may flow into and collect within bottom tray 138. Bulkhead 140 may be mounted to bottom tray 138 and extend upwardly from bottom tray 138 to a top wall of casing 110. Bulkhead 140 limits or prevents air flow between interior side portion 112 of casing 110 and exterior side portion 114 of casing 110 within mechanical compartment 116 of casing 110. Thus, bulkhead 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
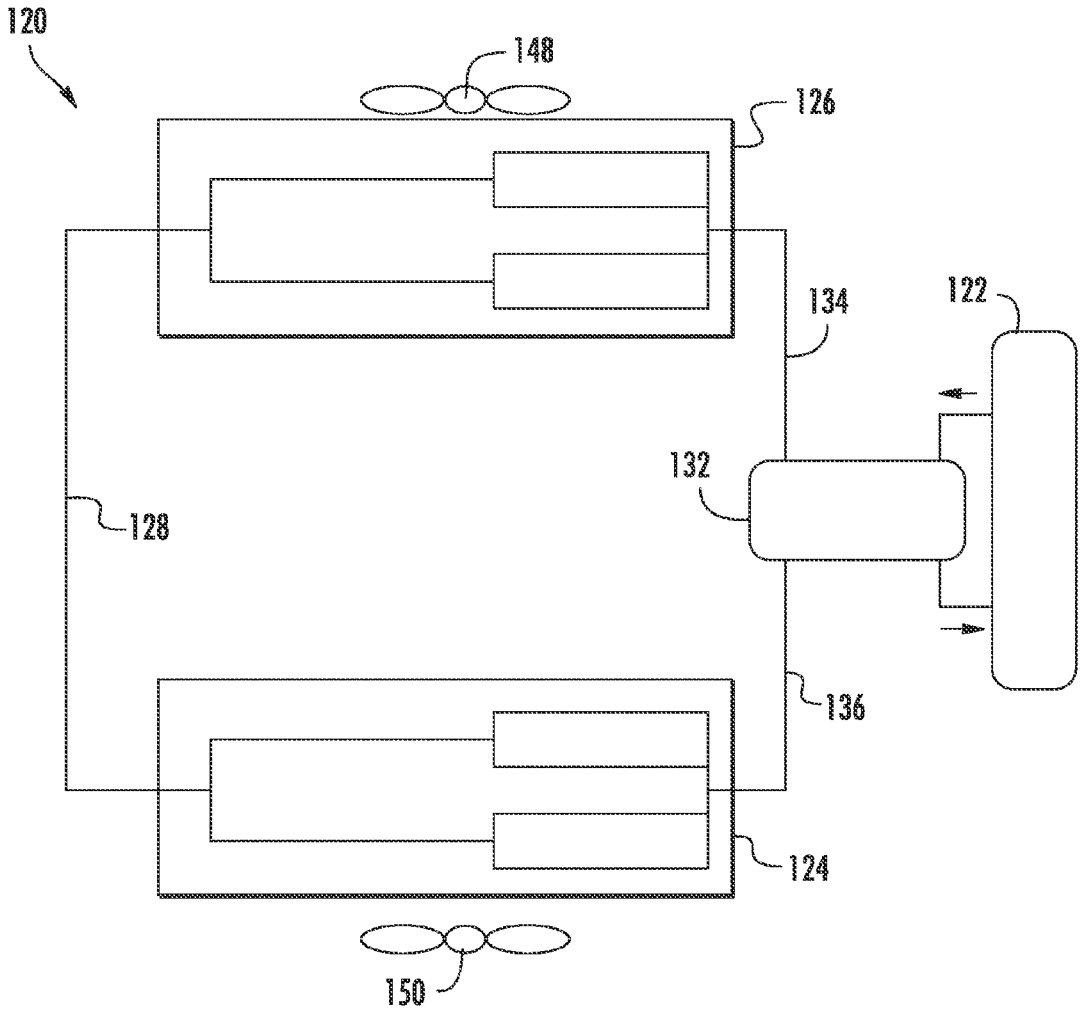
FIG. 2 provides a schematic view of certain components of the exemplary packaged terminal air conditioner unit of FIG. 1.

FIG. 2 provides a schematic view of certain components of packaged terminal air conditioner unit 100, including sealed system 120. Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 2, sealed system 120 may also include a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 flows through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 148 is positioned adjacent exterior coil 126 may facilitate or urge a flow of air from the exterior atmosphere across exterior coil 126 in order to facilitate heat transfer.

Sealed system 120 also includes a capillary tube 128 disposed between interior coil 124 and exterior coil 126, e.g., such that capillary tube 128 extends between and fluidly couples interior coil 124 and exterior coil 126. Refrigerant, which may be in the form of high liquid quality/saturated liquid vapor mixture, may exit exterior coil 126 and travel through capillary tube 128 before flowing through interior coil 124. Capillary tube 128 may generally expand the refrigerant, lowering the pressure and temperature thereof. The refrigerant may then be flowed through interior coil 124.

Interior coil 124 is disposed downstream of capillary tube 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, the liquid or liquid vapor mixture refrigerant from capillary tube 128 may enter interior coil 124 via a second distribution conduit 136 that extends between and fluidly connects interior coil 124 and reversing valve 132. Within interior coil 124, the refrigerant from capillary tube 128 receives energy from the interior atmosphere and vaporizes into superheated vapor and/or high quality vapor mixture. An interior air handler or fan 150 is positioned adjacent interior coil 124 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of capillary tube 128 in the heating mode and acts as an evaporator, e.g., such that exterior coil 126 is operable to heat refrigerant within exterior coil 126 with energy from the exterior atmosphere at exterior side portion 114 of casing 110.

It should be understood that sealed system 120 described above is provided by way of example only. In alternative exemplary embodiments, sealed system 120 may include any suitable components for heating and/or cooling air with a refrigerant. Similarly, sealed system 120 may have any suitable arrangement or configuration of components for heating and/or cooling air with a refrigerant in alternative exemplary embodiments.

Figure 3:
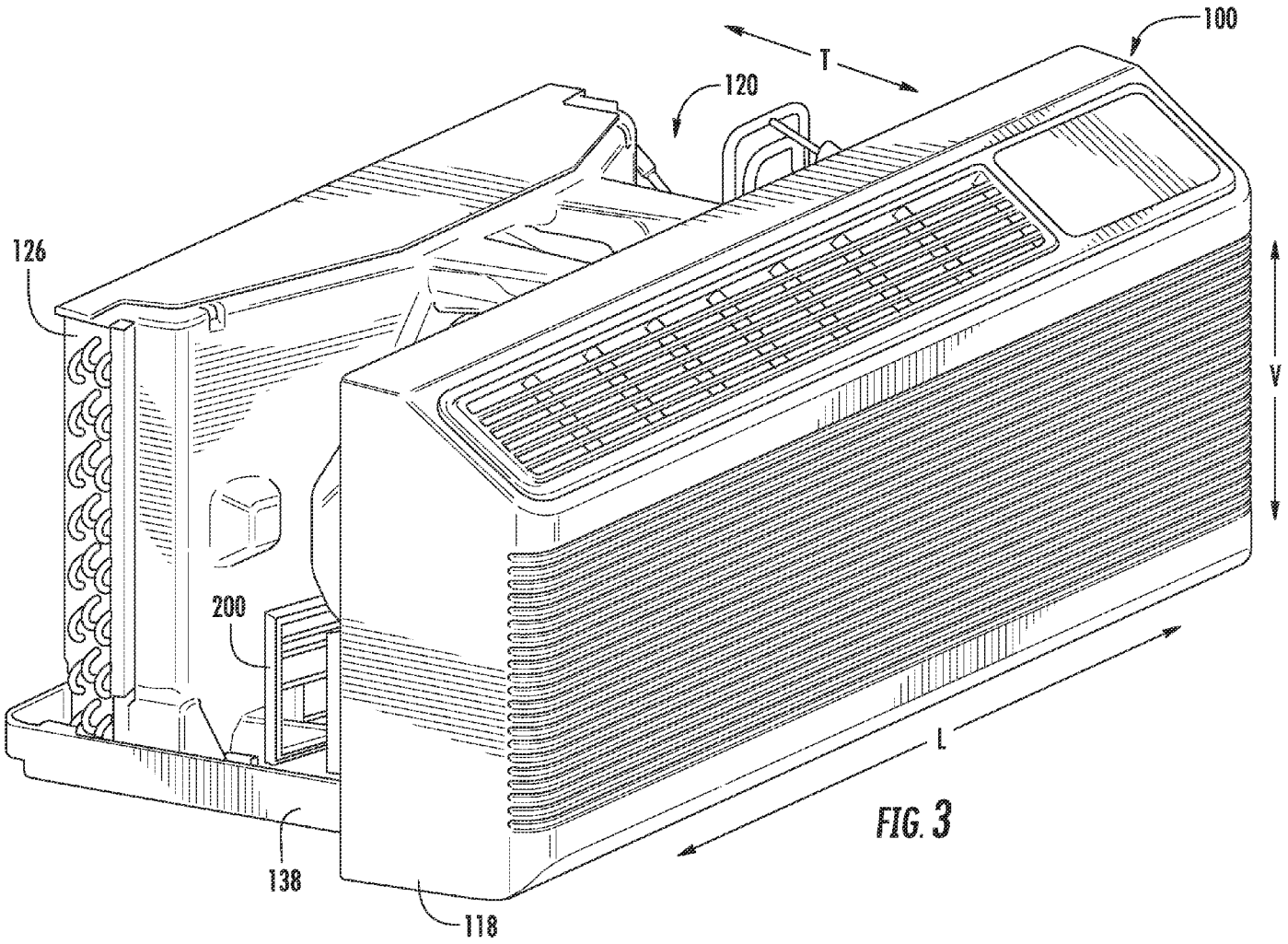
FIG. 3 provides a front, perspective view of the exemplary packaged terminal air conditioner unit of FIG. 1.
Figure 4:
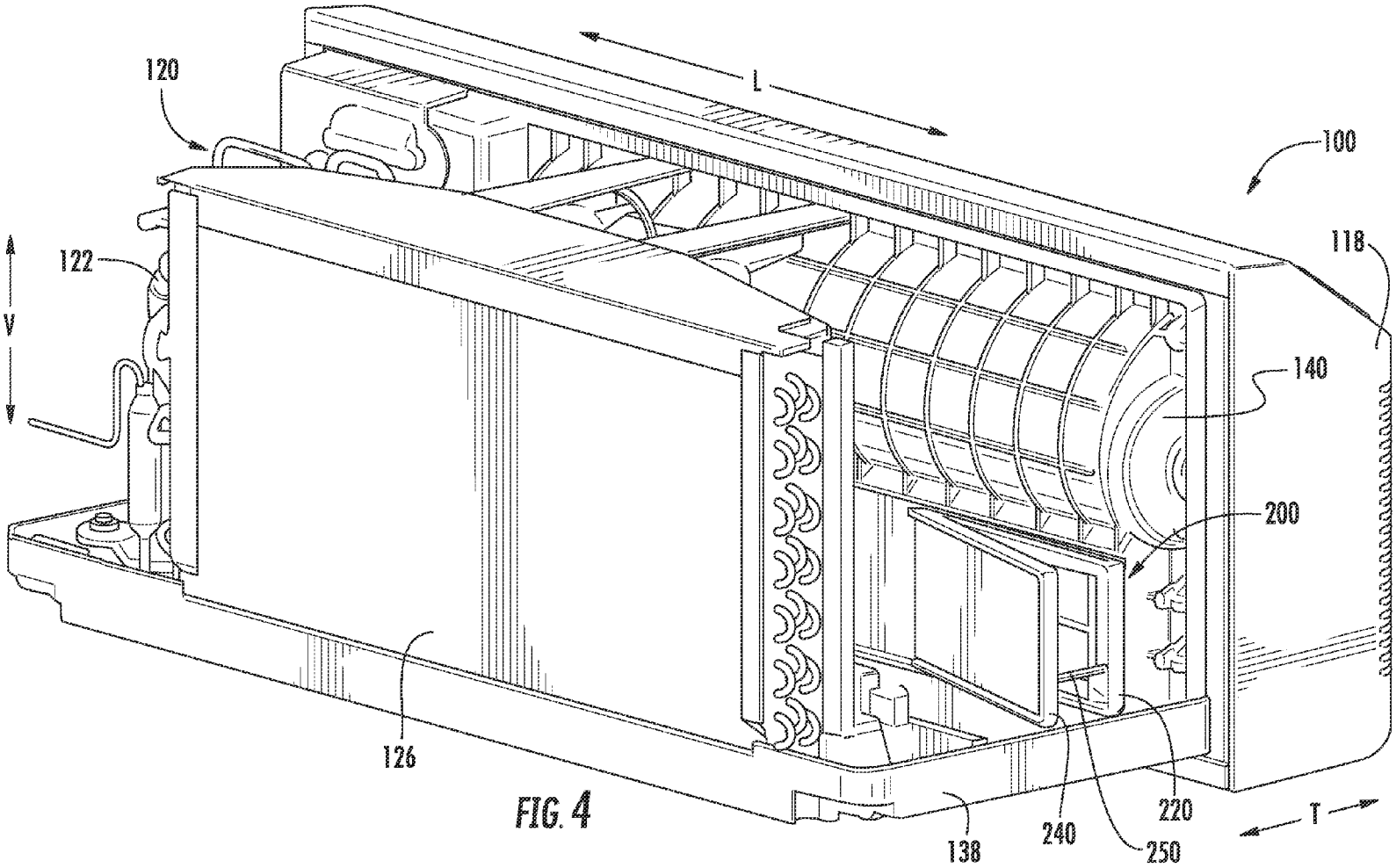
FIG. 4 provides a rear, perspective view of the exemplary packaged terminal air conditioner unit of FIG. 1.

FIG. 3 provides a front, perspective view of packaged terminal air conditioner unit 100. FIG. 4 provides a rear, perspective view of packaged terminal air conditioner unit 100. As may be seen in FIG. 4, packaged terminal air conditioner unit 100 includes a bulkhead 140. Bulkhead 140 may be disposed between interior side portion 112 of casing 110 and exterior side portion 114 of casing 110, e.g., along the transverse direction T, within casing 110. In particular, bulkhead 140 may divide mechanical compartment 116 of casing 110 into the interior side portion 112 of casing 110 and exterior side portion 114 of casing 110. As may be seen in FIGS. 3 and 4, a vent assembly 200 is mounted to bulkhead 140 within casing 110.

Figure 5:
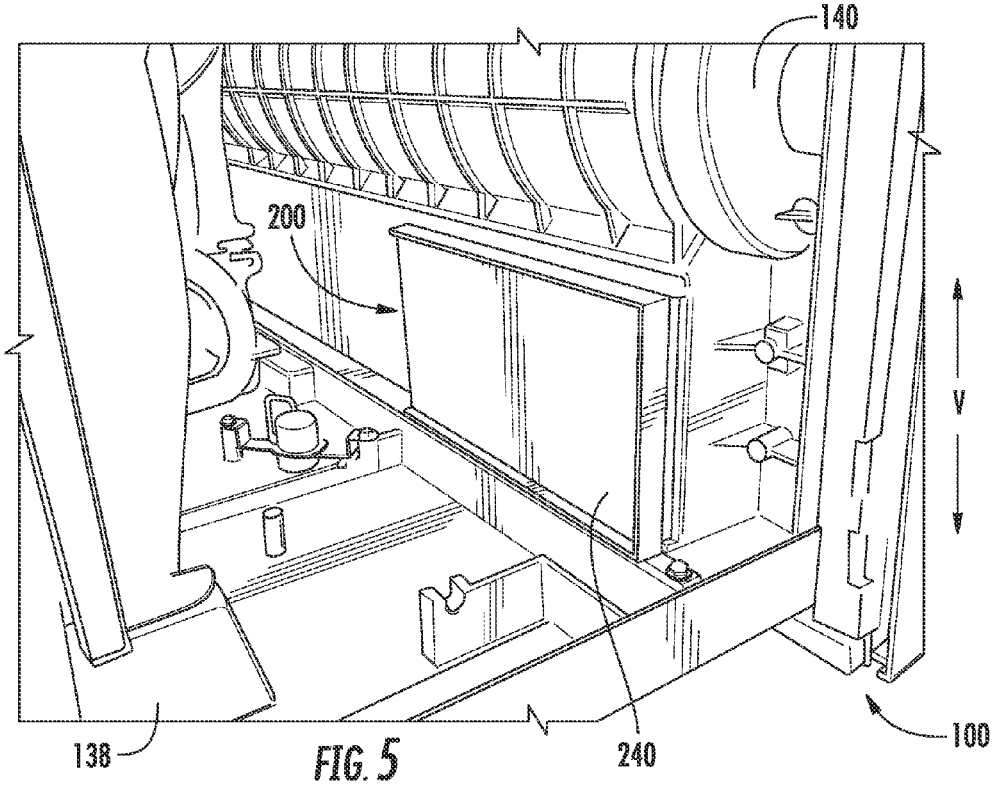
FIGS. 5 and 6 provide perspective views of a vent assembly of the exemplary packaged terminal air conditioner unit of FIG. 1 with the vent assembly shown in a closed configuration and an open configured, respectively.
Figure 6:
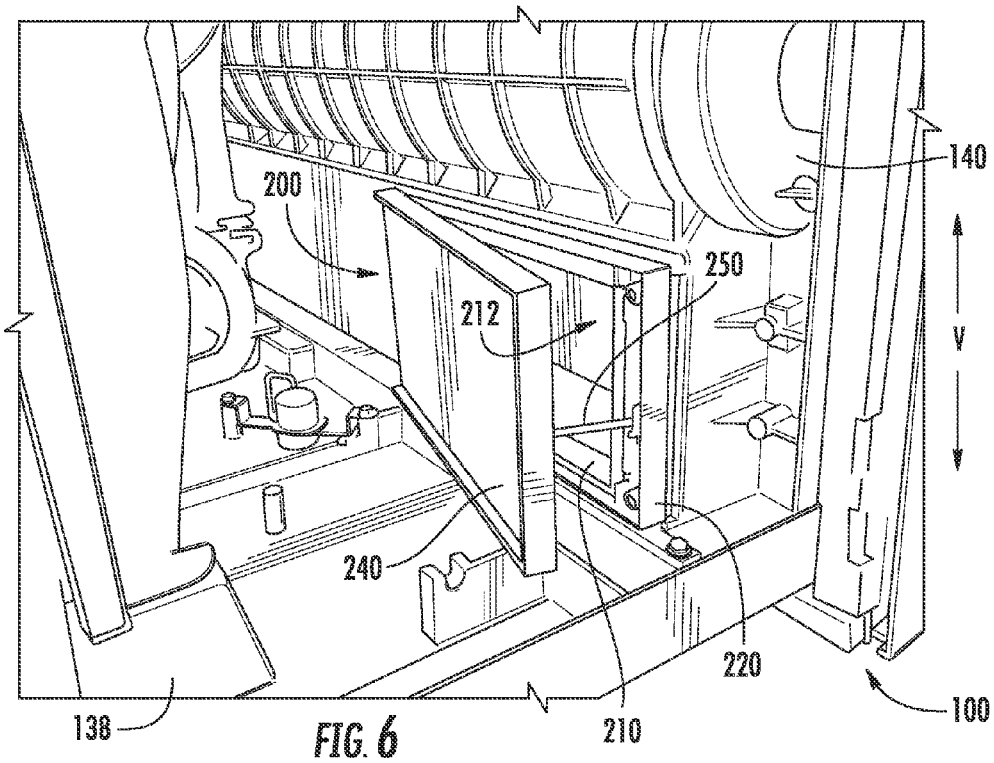
Figure 7:
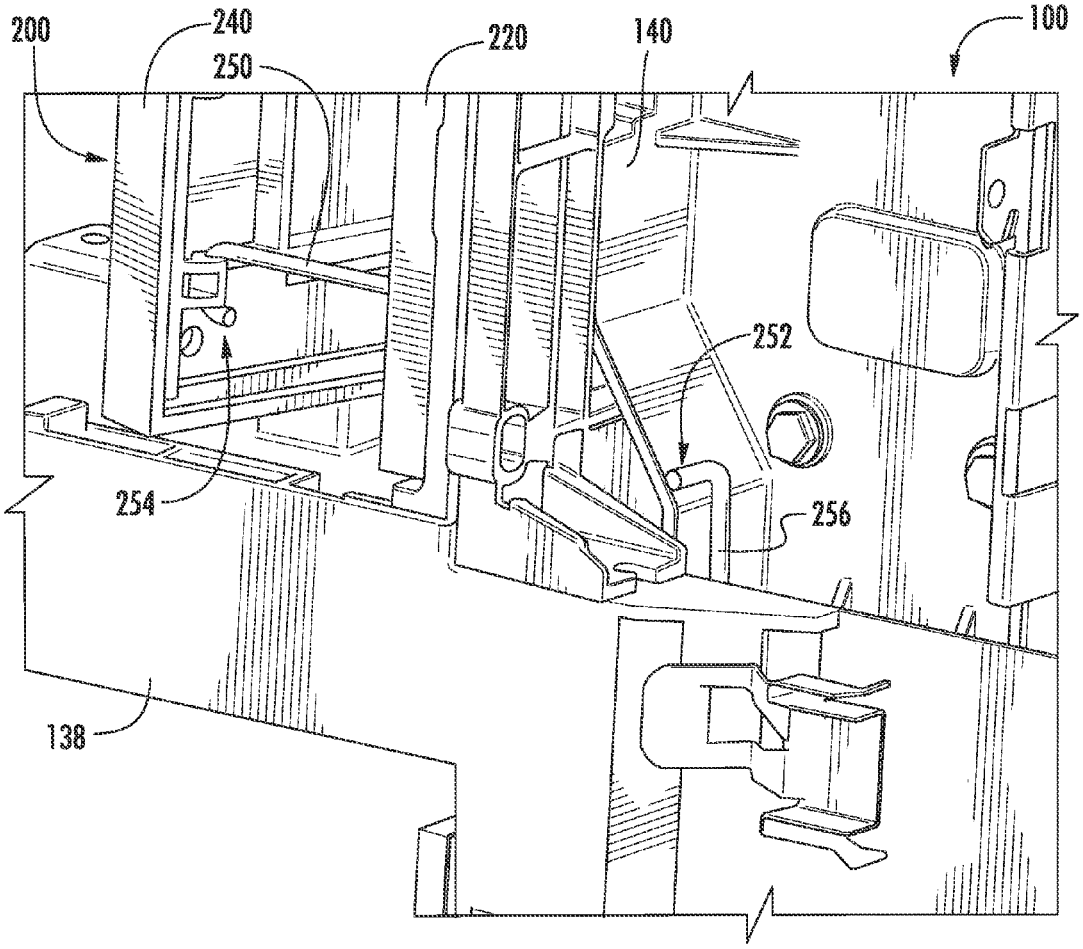
FIG. 7 provides a partial perspective view of the exemplary packaged terminal air conditioner unit of FIG. 1.

FIGS. 5 and 6 provide perspective views of vent assembly 200 of packaged terminal air conditioner unit 100. In FIG. 5, vent assembly 200 is shown in a closed configuration. Conversely, vent assembly 200 is shown in an open configuration in FIG. 6. FIG. 7 provides a partial perspective view of packaged terminal air conditioner unit 100.

As shown in FIG. 7, packaged terminal air conditioner unit 100 includes an actuator 250. Actuator 250 extends between a first end portion 252 and a second end portion 254, e.g., along the transverse direction T. Actuator 250 extends through bulkhead 140, e.g., along the transverse direction T. Thus, first end portion 252 of actuator may be disposed at or in interior side portion 112 of casing 110, and second end portion 254 of actuator 250 may be disposed at or in exterior side portion 114 of casing 110. First end portion 252 of actuator 250 may form a handle 256 such that a user may grasp first end portion 252 of actuator 250 from interior side portion 112 of casing 110. Second end portion 254 of actuator 250 is coupled to vent assembly 200. Thus, the user may pull on handle 256 of actuator at interior side portion 112 of casing 110 to adjust vent assembly 200 between the closed configuration shown in FIG. 5 and the open configuration shown in FIG. 6, e.g., without having to remove casing 110 in order to access exterior side portion 114 of casing 110 and/or vent assembly 200.

Figure 8:
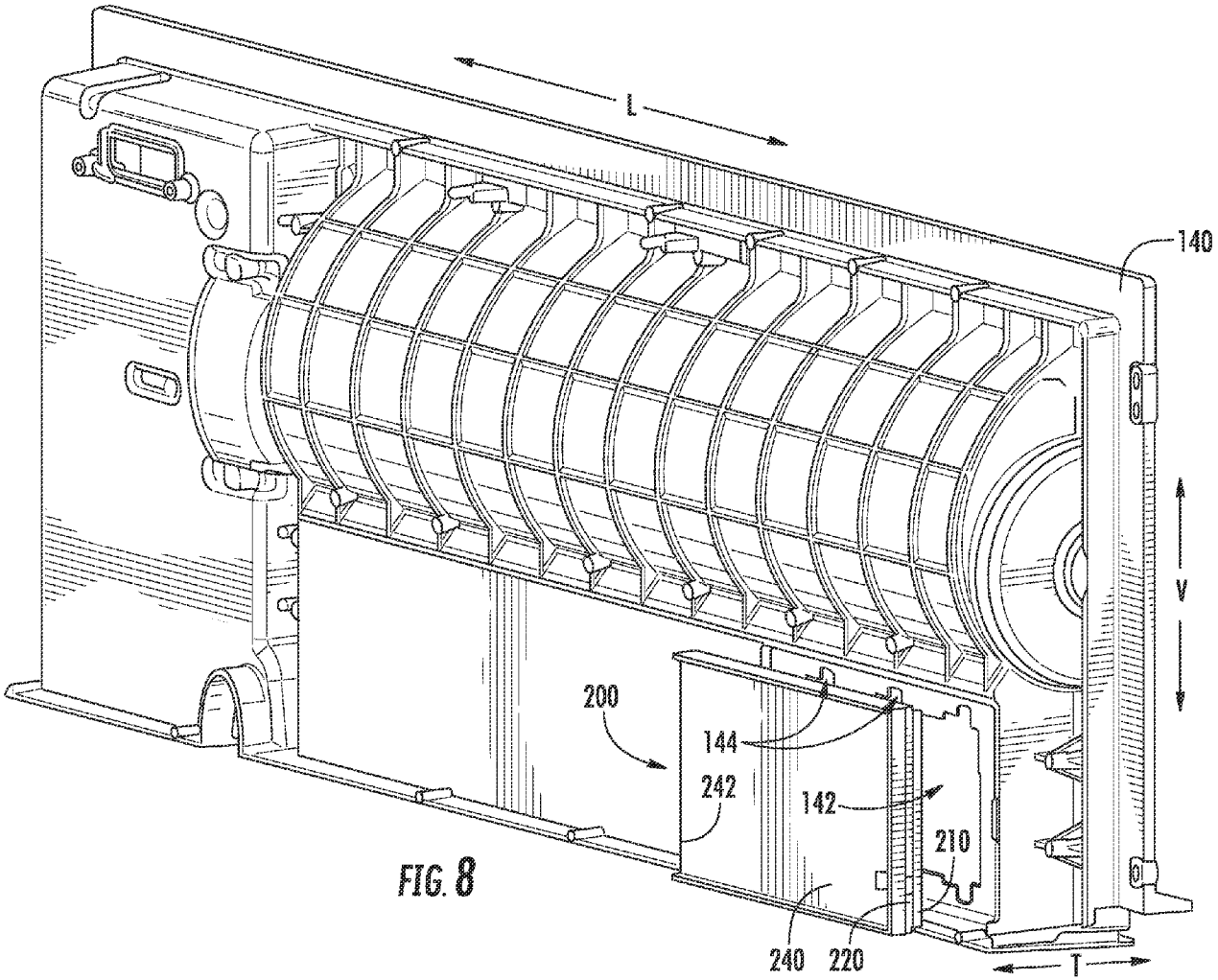
FIGS. 8 and 9 provide rear perspective views of a bulkhead of the exemplary packaged terminal air conditioner unit of FIG. 1 and the vent assembly of the exemplary packaged terminal air conditioner unit.
Figure 9:
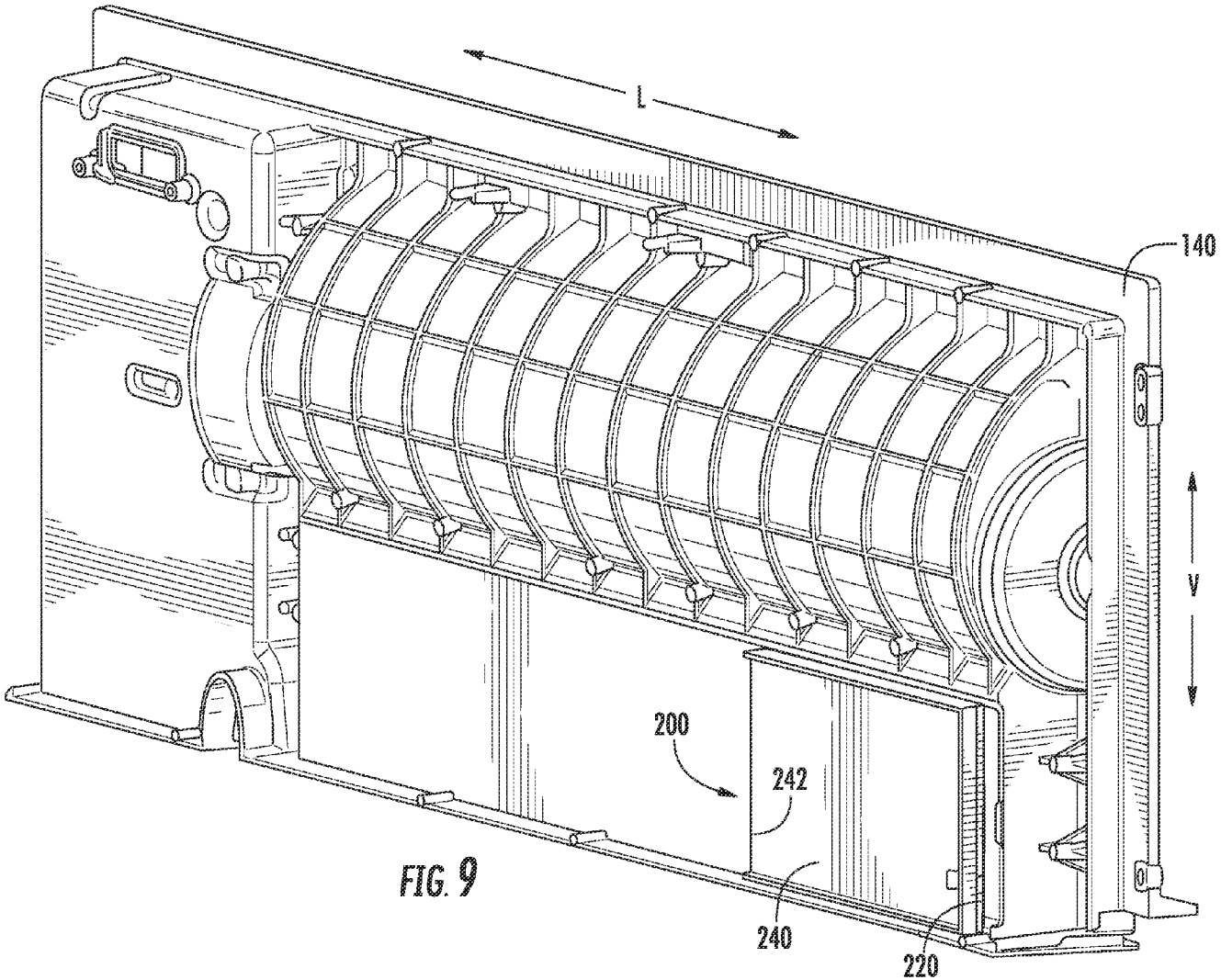

FIGS. 8 and 9 provide rear perspective views of bulkhead 140 and vent assembly 200 of packaged terminal air conditioner unit 100. As may be seen in FIG. 8, bulkhead 140 defines a vent aperture or opening 142. Opening 142 of bulkhead 140 extends through bulkhead 140, e.g., along the transverse direction T, such that a flow of air may flow through bulkhead 140 via opening 142. Thus, opening 142 of bulkhead 140 provides a passage for the flow of air through bulkhead 140 between interior side portion 112 of casing 110 and exterior side portion 114 of casing 110 within casing 110. For example, when vent assembly 200 is in the closed configuration shown in FIG. 5, vent assembly 200 blocks or obstructs the flow of air through opening 142 of bulkhead 140. Conversely, vent assembly 200 may permit the flow of air through bulkhead 140 via opening 142 when vent assembly 200 is in the open configuration shown in FIG. 6. Thus, a user may selectively adjust vent assembly 200 between the open and closed configurations in order to selectively permit the flow of air through bulkhead 140 via opening 142.

Turning back to FIGS. 5 and 6, vent assembly 200 includes a base 210, a frame 220 and a door 240. Base 210 is received or positioned within opening 142 of bulkhead 140. Thus, base 210 may be sized in a manner that is complementary to opening 142 such that base 210 fits within opening 142. Opening 142 of bulkhead 140 and base 210 may have any suitable shape. For example, opening 142 and base 210 may be generally rectangular, oval or any other suitable polygonal shape, e.g., in a plane that is perpendicular to the transverse direction T.

Base 210 defines a base aperture 212 within frame 220. Base 210 may be positioned such that base aperture 212 is generally aligned with opening 142 of bulkhead 140. Accordingly, when door 240 of vent assembly 200 is positioned in the open configuration, air flow through opening 142 may also flow through base aperture 212. A suitable filter medium (not shown) may be disposed within opening 142 and/or base aperture 212. Any suitable filter medium may be utilized, such as for example a filter having a polypropylene frame and a polypropylene filter mesh.

Frame 220 is mounted to base 210 and, e.g., extends about base 210. Thus, frame 220 may be wider along at least one of the vertical direction V and lateral direction L than base 210. In addition, frame 220 may be wider along at least one of the vertical direction V and lateral direction L than opening 142 of bulkhead 140. Thus, frame 220 may contact and be positioned at bulkhead 140 when vent assembly 200 is mounted to bulkhead 140, as discussed in greater detail below.

Door 240 is pivotally connected or mounted to base 210. For example, a hinge 242 rotatably or pivotally connects door 240 to base 210 such that an axis of hinge 242 is parallel to the vertical direction V or lateral direction L. Door 240 may be rotatable or pivotable between the closed configuration, shown in FIGS. 5 and 9, and the open configuration, shown in FIGS. 4 and 6. In the closed configuration, door 240 generally contacts base 210 and/or frame 220 and restricts or prevents air flow through vent assembly 200, such as through base aperture 212. Accordingly, little or no air flow through opening 142 from interior side portion 112 of casing 110 to exterior side portion 114 of casing 110 or from exterior side portion 114 of casing 110 to interior side portion 112 of casing 110 is permitted in the closed configuration. In the open configuration, door 240 is generally spaced from base 210 and/or frame 220 and rotated away from base 210 and/or frame 220 such that air flow through vent assembly 200, such as through base aperture 212, is allowed. Accordingly, air flow through opening 142 from interior side portion 112 of casing 110 to exterior side portion 114 of casing 110 or from exterior side portion 114 of casing 110 to interior side portion 112 of casing 110 is allowed in the open configuration.

The use of hinge 242 to connect door 240 and base 210 provides numerous advantages for bulkhead 140 and packaged terminal air conditioner unit 100. For example, door 240 may be easily opened by rotating the door 240 from the closed configuration to the open configuration and easily closed by rotating door 240 from the open configuration to the closed configuration. Further, when door 240 is in the open configuration, door 240 advantageously remains connected to base 210, thus ensuring that door 240 will not be lost. Still further, use of vent assembly 200 in accordance with the present disclosure may reduce vent assembly 200 construction costs and times, by advantageously reducing and simplifying the number of components required for venting operations in bulkhead 140.

Base 210, frame 220, door 240 and hinge 242 may, in certain exemplary embodiments as shown, be integrally formed with one another and thus formed as a single, unitary component. Alternatively, however, these components may be formed separately and coupled together to form vent assembly 200. Further, in certain exemplary embodiments, hinge 242 is a living hinge. A living hinge is a thin, flexible hinge made from the same material as the two rigid components that the living hinge connects. For example, vent assembly 200, and thus base 210, frame 220, door 240 and hinge 242 thereof, may in certain exemplary embodiments be formed from plastics, such as a polyethylene or polypropylene. Alternatively, vent assembly 200, and thus base 210, frame 220, door 240 and hinge 242 thereof, may be formed from metals or other suitable materials. In exemplary embodiments the same material is utilized for base 210, frame 220, door 240 and hinge 242.

Figure 10:
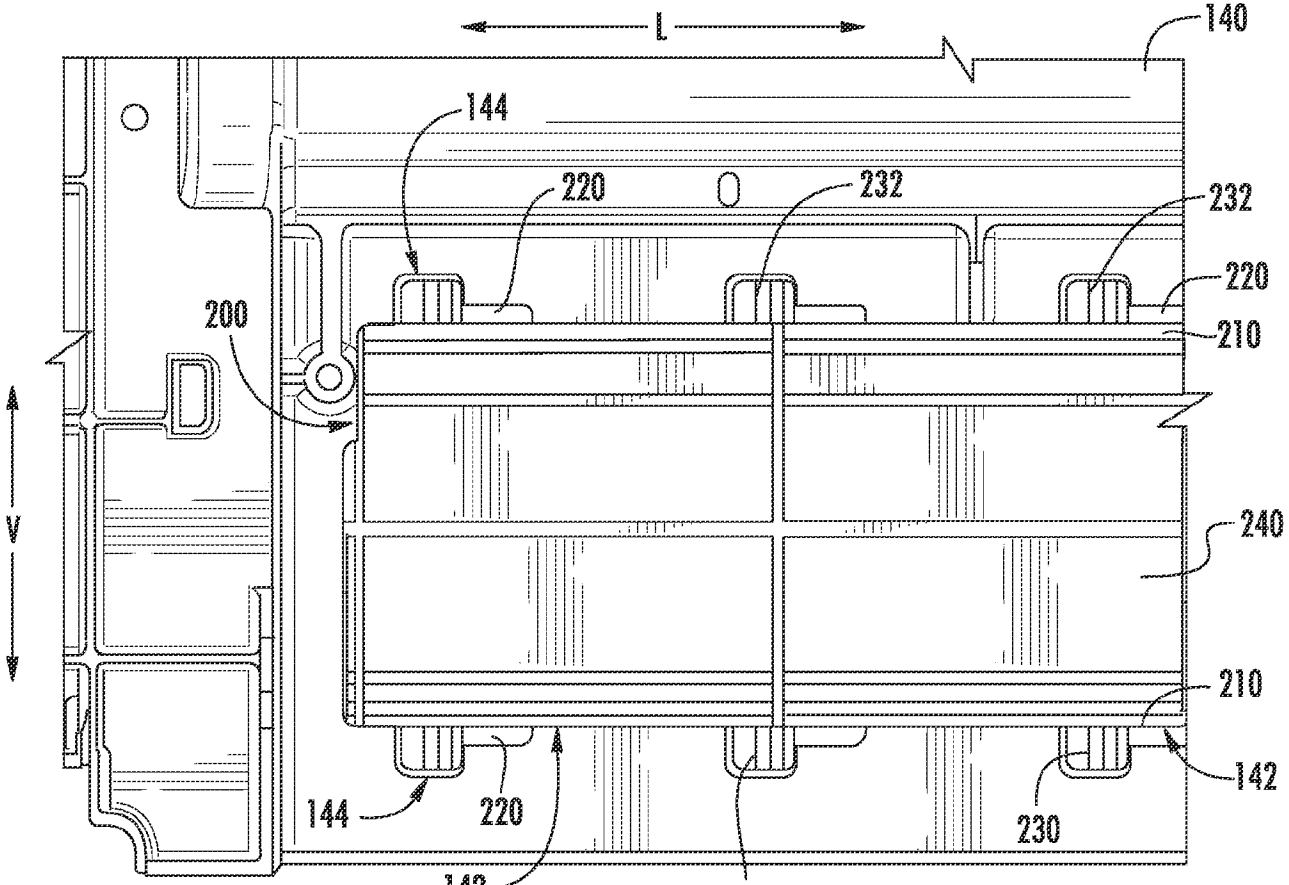
FIGS. 10 and 12 provide front elevation views of the bulkhead and vent assembly of FIG. 7 with the vent assembly shown in various states of being mounted to the bulkhead.
Figure 11:
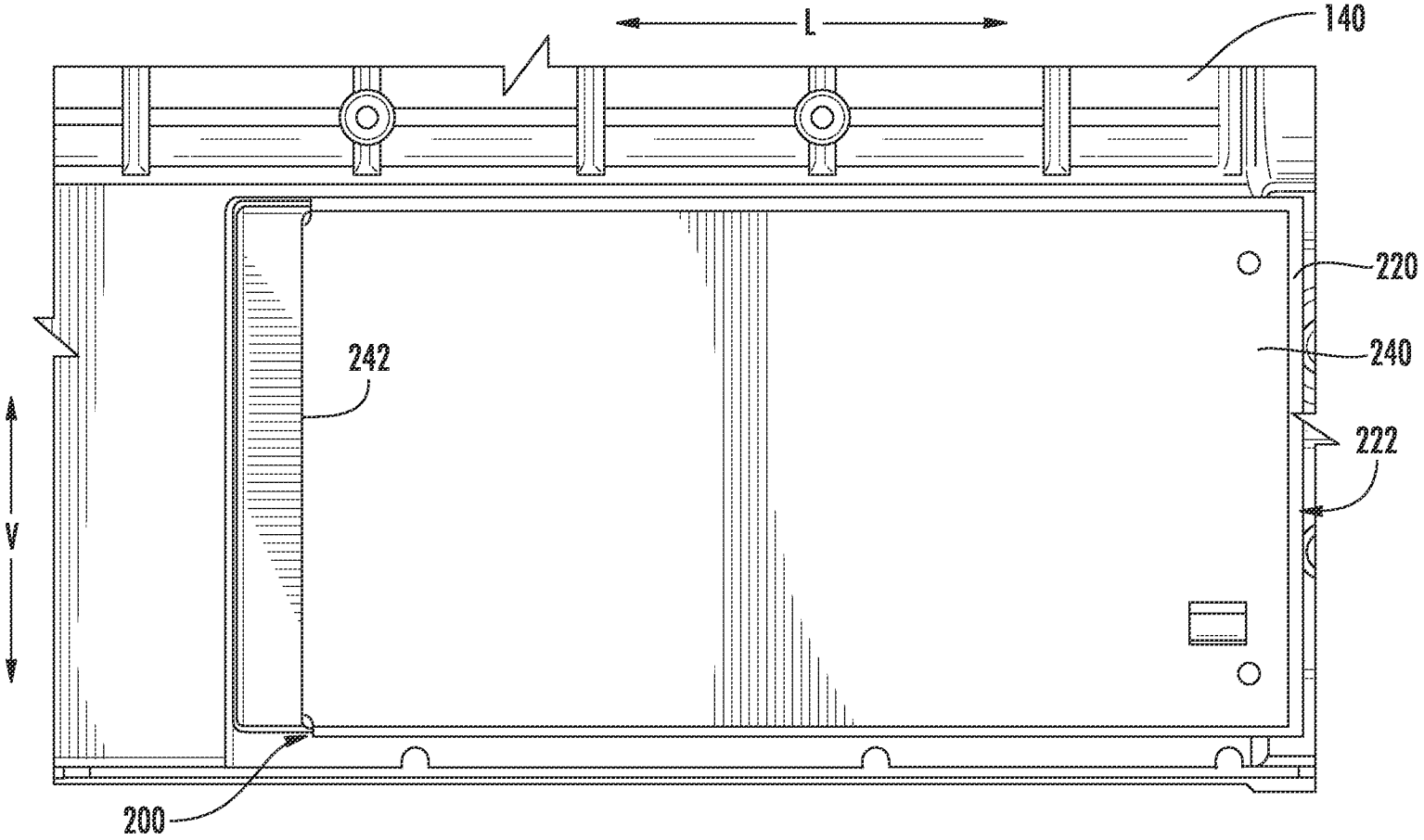
FIGS. 11 and 13 provide rear elevation views of the bulkhead and vent assembly of FIG. 7 with the vent assembly shown in various states of being mounted to the bulkhead.
Figure 12:
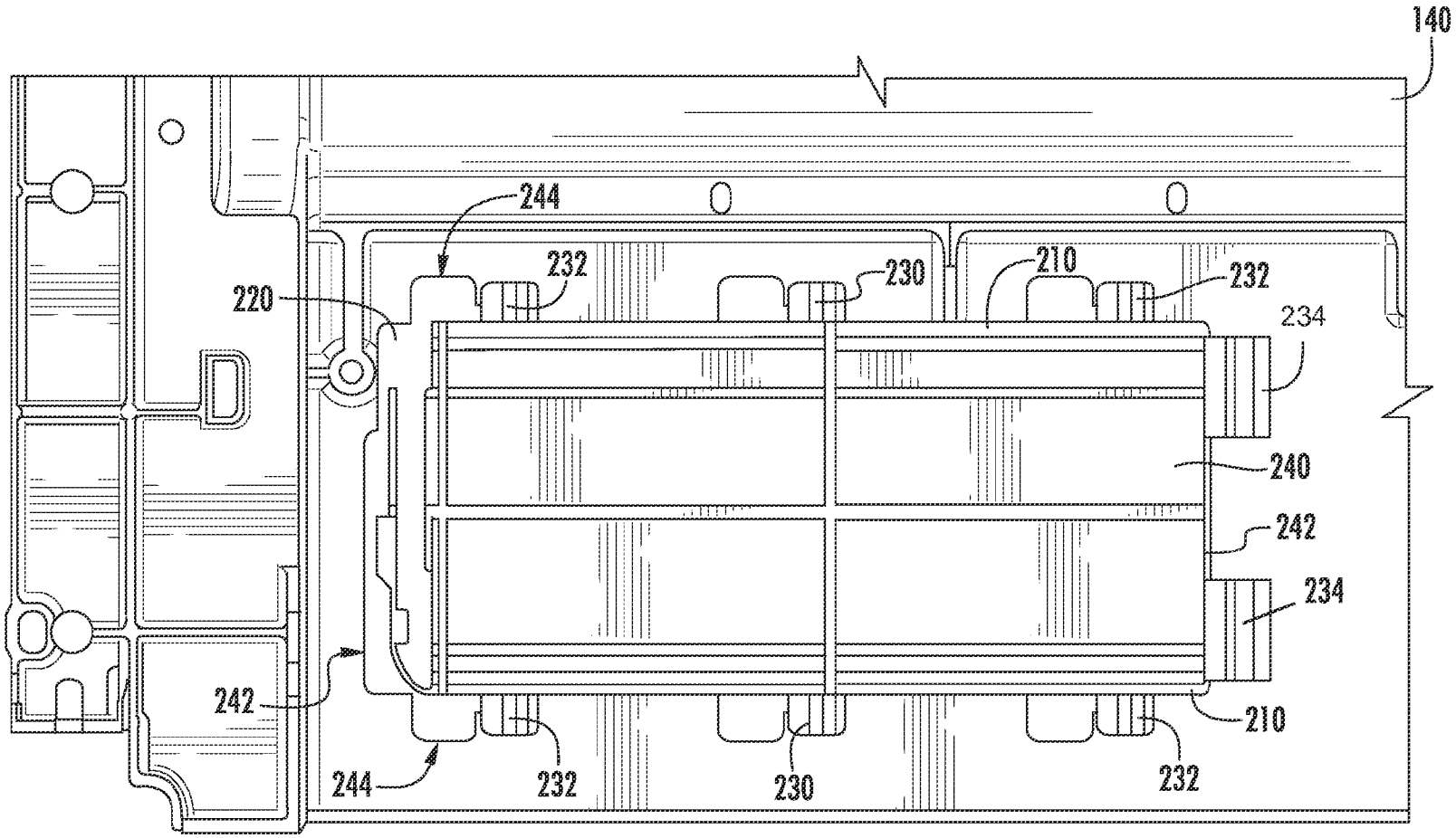
Figure 13:
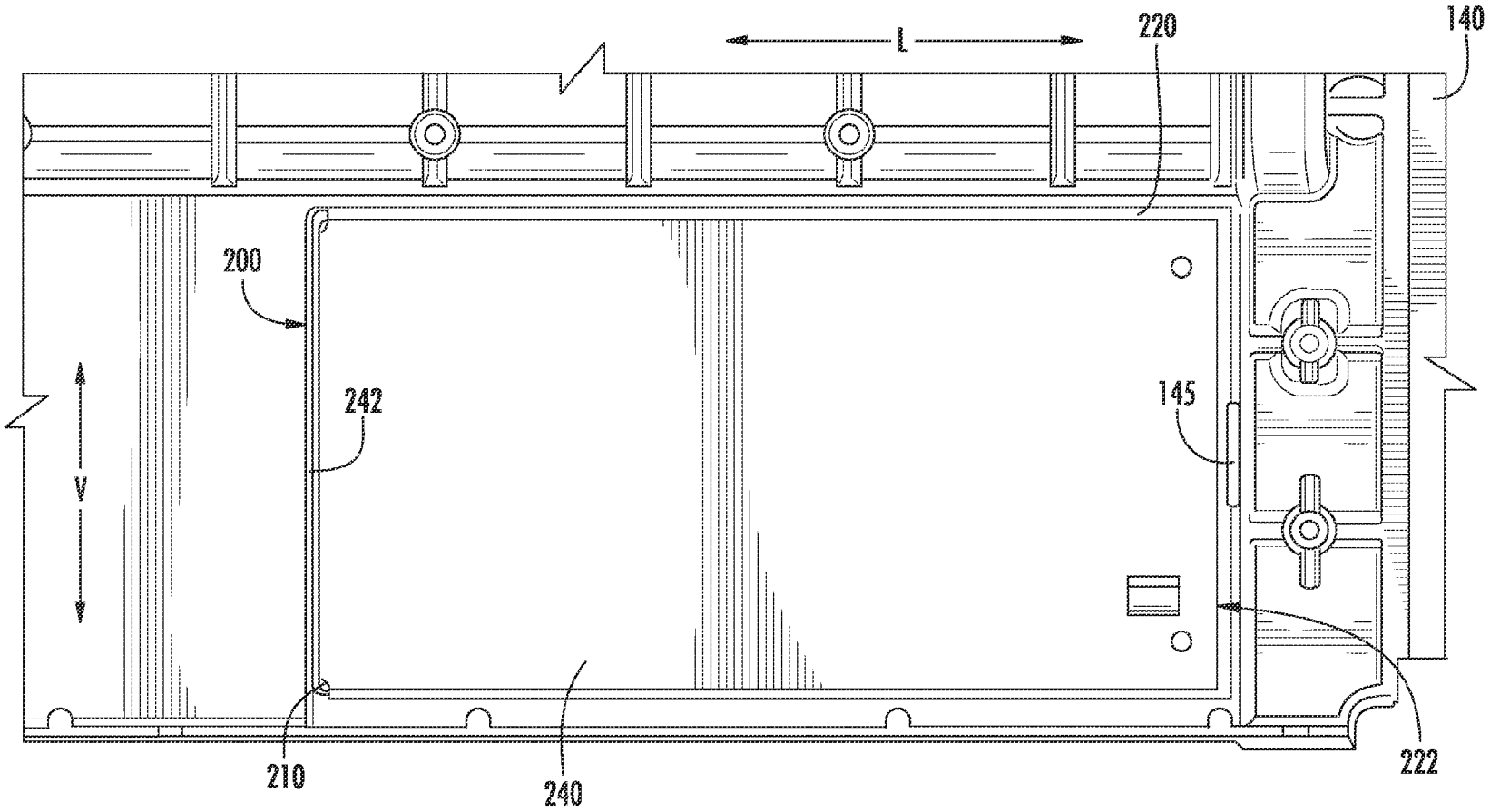

FIGS. 10 and 12 provide front elevation views of bulkhead 140 and vent assembly 200 with vent assembly 200 shown in various states of being mounted to bulkhead 140. FIGS. 11 and 13 provide rear elevation views of bulkhead 140 and vent assembly 200 with vent assembly 200 shown in various states of being mounted to bulkhead 140. Mounting of vent assembly 200 to bulkhead 140 is discussed in greater detail below in the context of FIGS. 10-13.

As may be seen in FIGS. 10 and 12, vent assembly 200 includes a plurality of projections 230, e.g., eight projections 230 are shown in the exemplary embodiment of FIGS. 10 and 12. Projections 230 are mounted to or integrally formed with base 210. Projections 230 may extend from base 210 along at least one of the vertical direction V and the lateral direction L. For example, as shown in FIG. 12, projections 230 may include at least six vertical projections 232 that extend from base 210 along the vertical direction V and at least two lateral projections 234 that extend from base 210 along the lateral direction L. Projections 232 cooperate with frame 220 to mount vent assembly 200 to bulkhead 140, as discussed in greater detail below.

As may be seen in FIGS. 10 and 12, bulkhead 140 defines a plurality of slots 144. Slots 144 are sized for receiving projections of projections 230, e.g., vertical projections 232. Thus, slots 144 may extend from opening 142 of bulkhead 140 along the vertical direction V by a height that is about equal to a height to projections 230 along the vertical direction V. As used herein the term "about" means within ten percent of the stated height when used in the context of heights. Thus, when vent assembly 200 is positioned on bulkhead 140, vertical projections 232 may be aligned with and inserted into slots 144 such that frame 220 is positioned on bulkhead 140 opposite projections 230, as shown in FIG. 10. In such a manner, slots 144 allow projections 230 to pass through bulkhead 140.

From the position shown in FIG. 10, vent assembly 200 may be shifted or moved along the lateral direction to the position shown in FIG. 12. After vent assembly 200 is shifted or moved along the lateral direction from the position shown in FIG. 10 to the position shown in FIG. 12, each slot of slots 144 is offset from or unaligned with a respective projection of projections 230 (e.g., vertical projections 232) along the lateral direction L.

As may be seen in FIG. 12, both frame 220 and projections 230 may be positioned on or at bulkhead 140, e.g., at opposite sides of bulkhead 140 along the transverse direction T, at opening 142, when vent assembly 200 is shifted to the position shown in FIG. 12. Thus, bulkhead 140 may be positioned between frame 220 and projections 230 along the transverse direction T when vent assembly 200 is mounted to bulkhead 140. In particular, frame 220 and projections 230 are spaced apart from one another along the transverse direction T by about a thickness of bulkhead 140 along the transverse direction T at opening 142 of bulkhead 140. As used herein the term "about" means within ten percent of the stated thickness when used in the context of thicknesses. Thus, bulkhead 140 may be sandwiched between frame 220 and projections 230 in order to mount vent assembly 200 to bulkhead 140. In such a manner, frame 220 and projections 230 may engage bulkhead 140 such that bulkhead 140 interferes with or prevents movement of vent assembly 200 along the transverse direction T relative to bulkhead 140.

As may be seen in FIG. 12, hinge 242 may be positioned at or proximate lateral projections 234 on base 210. Such positioning of hinge 242 relative to lateral projections 234 on base 210 may assist with limiting deformation of base 210 and/or frame 220 during opening and closing of door 240. In particular, bulkhead 140 may be positioned between frame 220 and lateral projections 234 along the transverse direction T when vent assembly 200 is mounted to bulkhead 140 as shown in FIG. 12. Thus, e.g., bulkhead 140 may extend between frame 220 and lateral projections 234 along the transverse direction T and thereby support vent assembly 200 during opening and closing of door 240 and limit deformation of vent assembly 200.

Turning now to FIGS. 11 and 13, bulkhead 140 also defines a ledge 145, e.g., ledge 145 may be integrally formed on bulkhead 140. Ledge 145 is positioned adjacent opening 142. Thus, as shown in FIG. 11, ledge 145 is positioned under frame 220 when projections 230 are positioned within slots 144 (as shown in FIG. 10). From the position shown in FIG. 11, vent assembly 200 may be shifted or moved along the lateral direction to the position shown in FIG. 13. After vent assembly 200 is shifted or moved along the lateral direction from the position shown in FIG. 11 to the position shown in FIG. 13, frame 220 may snap or otherwise elastically deform over ledge 145 such that an outer edge 222 of frame 220 is positioned on or at ledge 145 when vent assembly 200 is mounted to bulkhead 140. With outer edge 222 of frame 220 positioned at ledge 145, ledge 145 may limit or obstruct movement of vent assembly 200 relative to bulkhead 140 along the lateral direction L. Thus, ledge 145 may assist with mounting vent assembly 200 to bulkhead 140 at opening 142 of bulkhead 140.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit defining a vertical direction, a lateral direction and a transverse direction that are mutually perpendicular, the packaged terminal air conditioner comprising:

a casing;

a compressor positioned within the casing, the compressor operable to increase a pressure of a refrigerant;

an interior coil positioned within the casing;

an exterior coil positioned within the casing;

a bulkhead positioned between the interior coil and the exterior coil along the transverse direction within the casing, the bulkhead defining an opening that extends through the bulkhead along the transverse direction, the bulkhead also defining a plurality of slots at the opening of the bulkhead; and a vent assembly comprising a base received within the opening of the bulkhead;

a frame mounted to the base and positioned on the bulkhead at the opening of the bulkhead;

a plurality of projections mounted to the base and positioned on the bulkhead at the opening of the bulkhead, the bulkhead positioned between the plurality of projections and the frame along the transverse direction, the slots of the plurality of slots sized for receiving the projections of the plurality of projections, each slot of the plurality of slots offset from a respective projection of the plurality of projections when the vent assembly is mounted to the bulkhead; and a door pivotally mounted to the base.

2. The packaged terminal air conditioner unit of claim 1, Wherein the frame extends about the base and projections of the plurality of projections extend from the base along the vertical direction.

3. The packaged terminal air conditioner unit of claim 2, wherein projections of the plurality of projections also extend from the base along the lateral direction.

4. The packaged terminal air conditioner unit of claim 3, wherein the door is pivotally mounted to the base with a living hinge between the door and the base, the living hinge positioned proximate the projections of the plurality of projections that extend from the base along the lateral direction on the base.

5. The packaged terminal air conditioner unit of claim 4, wherein the bulkhead defines a ledge positioned adjacent the opening, an outer edge of the frame positioned at the ledge when the vent assembly is mounted to the bulkhead.

6. The packaged terminal air conditioner unit of claim 4, wherein the plurality of projections comprises at least six projections that extend from the base along the vertical direction and at least two projections that extend from the base along the lateral direction.

7. The packaged terminal air conditioner unit of claim 1, wherein the slots of the plurality of slots extend from the opening of the bulkhead along the vertical direction.

8. The packaged terminal air conditioner unit of claim 1, wherein the frame and the plurality of projections are spaced apart from each other along the transverse direction by a thickness of the bulkhead along the transverse direction at the opening of the bulkhead.

9. The packaged terminal air conditioner unit of claim 1, wherein the base, the frame, the plurality of projections and the door are integrally formed of a single, continuous piece of plastic.

10. A packaged terminal air conditioner unit defining a vertical direction, a lateral direction and a transverse direction that are mutually perpendicular, the packaged terminal air conditioner comprising:

a casing extending between an exterior side portion and an interior side portion along the transverse direction;

a compressor positioned within the casing, the compressor operable to compress a refrigerant;

an interior coil positioned within the casing at the interior side portion of the casing;

an exterior coil positioned within the casing at the exterior side portion of the casing;

a bulkhead positioned between the interior coil and the exterior coil along the transverse direction within the casing, the bulkhead defining an opening that extends through the bulkhead along the transverse direction, the bulkhead also defining a plurality of slots at the opening of the bulkhead; and a vent assembly comprising a base received within the opening of the bulkhead;

a frame mounted to the base and positioned on the bulkhead at the opening of the bulkhead and at the exterior side portion of the casing;

a plurality of projections mounted to the base and positioned opposite the frame about the bulkhead such that the bulkhead is positioned between the plurality of projections and the frame along the transverse direction, the slots of the plurality of slots sized for receiving the projections of the plurality of projections, each slot of the plurality of slots offset from a respective projection of the plurality of projections along the lateral direction when the vent assembly is mounted to the bulkhead; and a door pivotally mounted to the base.

11. The packaged terminal air conditioner unit of claim 10, wherein the frame extends about the base and projections of the plurality of projections extend from the base along the vertical direction.

12. The packaged terminal air conditioner unit of claim 11, wherein projections of the plurality of projections also extend from the base along the lateral direction.

13. The packaged terminal air conditioner unit of claim 12, wherein the door is pivotally mounted to the base with a living hinge between the door and the base, the living hinge positioned proximate the projections of the plurality of projections that extend from the base along the lateral direction on the base.

14. The packaged terminal air conditioner unit of claim 13, wherein the bulkhead defines a ledge positioned adjacent the opening, an outer edge of the frame positioned at the ledge when the vent assembly is mounted to the bulkhead.

15. The packaged terminal air conditioner unit of claim 14, Wherein the plurality of projections comprises at least six projections that extend from the base along the vertical direction and at least two projections that extend from the base along the lateral direction.

16. The packaged terminal air conditioner unit of claim 10, wherein the slots of the plurality of slots extend from the opening of the bulkhead along the vertical direction.

17. The packaged terminal air conditioner unit of claim 10, wherein the frame and the plurality of projections are spaced apart from each other along the transverse direction by a thickness of the bulkhead along the transverse direction at the opening of the bulkhead.

18. The packaged terminal air conditioner unit of claim 10, wherein the base, the frame, the plurality of projections and the door are integrally formed of a single, continuous piece of plastic.

* * * * *